United States Patent [19]

Chandler

[11] 4,225,202

[45] Sep. 30, 1980

[54] APPARATUS FOR SUPPORTINGLY ORGANIZING AND DISPLAYING MISCELLANEOUS ARTICLES

[76] Inventor: Earl E. Chandler, P.O. Box 1624, Coolidge, Ariz. 85228

[21] Appl. No.: 937,543

[22] Filed: Aug. 28, 1978

[51] Int. Cl.[2] ..... A47B 63/00; A47F 5/08; A47B 96/06

[52] U.S. Cl. ..... 312/184; 206/349; 211/96; 217/62; 223/107; 312/DIG. 33

[58] Field of Search ..... 312/244, DIG. 33, 184, 312/189; 211/96, 57.1, 59.1, 168; 248/201, 205; 206/349, 372, 373; 223/107; 217/62

[56] References Cited

U.S. PATENT DOCUMENTS

| | | | |
|---|---|---|---|
| 1,652,450 | 12/1927 | Miller | 211/96 |
| 2,136,168 | 11/1938 | Kern | 211/59.1 |
| 3,333,711 | 8/1967 | Melmer et al. | 211/96 |
| 3,831,805 | 8/1974 | Yonce | 206/373 |

FOREIGN PATENT DOCUMENTS

| | | | |
|---|---|---|---|
| 1249986 | 10/1971 | United Kingdom | 211/96 |

*Primary Examiner*—Roy D. Frazier
*Assistant Examiner*—Alexander Grosz
*Attorney, Agent, or Firm*—Herbert E. Haynes, Jr.

[57] ABSTRACT

A plurality of cantilever arms are demountably and pivotably attached in spaced relationship between a spaced pair of horizontally disposed mounting plates with those plates being supported on a suitable vertical surface. Each of the cantilever arms is provided with fasteners thereon from which a planar display panel is demountably suspended, with the display panel having fastener devices for demountably supporting miscellaneous articles thereon. In the preferred embodiment, the mounting plates are affixed to an internal vertical surface of an especially configured carrying box.

10 Claims, 4 Drawing Figures

APPARATUS FOR SUPPORTINGLY ORGANIZING AND DISPLAYING MISCELLANEOUS ARTICLES

BACKGROUND OF THE INVENTION

1. Field of the Invention

This invention relates to article supporting structures and more particularly to an apparatus for demountably supporting and displaying miscellaneous articles.

2. Description of the Prior Art

Many article supporting and/or carrying structures have been devised for various articles such as tools, fishing tackle, sewing supplies, and the like, with those prior art structures most often being in the form of a box with a hinged lid and having a multiplicity of trays, drawers, or other compartments formed therein. Such structures, although serving the purpose, are not always convenient to use in that the various types of compartments usually contain a multiplicity of articles which can make access to an individual article somewhat difficult and often delays locating of a desired one of the articles.

In addition to box shaped article carrying structures, the prior art is replete with cabinet structures for containing various articles which are usually supported on shelves or contained within drawers. These cabinet structures often provide the same difficulties as the above described boxes with regard to access to and location of individual articles.

In general, the prior art article supporting and/or carrying structures make no provisions for organized display of the various articles either within the structure or externally thereof, but simply contain those articles in a more or less disorganized manner.

Therefore, it is desirable to provide a new and useful apparatus for supportingly displaying and/or carrying various articles which overcomes some of the problems and shortcomings of the prior art.

SUMMARY OF THE INVENTION

In accordance with the present invention, an apparatus is disclosed for supporting and/or carrying miscellaneous articles in an organized display like arrangement, with the apparatus including a plurality of cantilever arms demountably and pivotably carried between a pair of spaced mounting plates, with the mounting plates affixed to any suitable vertical surface. The cantilever arms are provided with means for demountably suspendingly supporting planar display panels, with those display panels having fastener means thereon for supportingly carrying miscellaneous articles in organized arrays. Due to the demountability of the display panels, they may be easily removed from the cantilever arms for remote display purposes or to provide improved access to the individual articles carried thereon.

In a preferred embodiment, the apparatus of the present invention is in combination with a special carrying box which includes a base having a floor with one upstanding wall to which the mounting plates of the apparatus are affixed, so that the cantilever arms are spaced above the floor of the base with the display panels depending from the cantilever arms towards the floor. A cover, including a top with three depending walls, is removably attached to the base and has a handle by which the entire assembly may be carried.

Accordingly, it is an object of the present invention to provide a new and improved article supporting and displaying apparatus.

Another object of the present invention is to provide a new and improved article supporting and displaying apparatus which is inexpensive to manufacture and simple to use.

Another object of the present invention is to provide a new and improved article supporting and displaying apparatus which may be affixed to any vertical surface.

Another object of the present invention is to provide a new and improved article supporting and displaying apparatus in which various miscellaneous articles are demountably supported in organized arrays on removable display panels.

Another object of the present invention is to provide a new and improved article supporting and displaying apparatus of the above described character in which the display panels are carried on cantilever arms which are pivotably and demountably carried between a spaced pair of fixed mounting plates.

Still another object of the present invention is to provide a new and improved article supporting and displaying apparatus of the above described character in combination with a special carrying box which includes a base having a floor with one upstanding wall on which the mounting plates of the apparatus are affixed, and a cover having three depending walls with the cover being demountably connectable to the base.

The foregoing and other objects of the present invention, as well as the invention itself, may be more fully understood from the following description when read in conjunction with the accompanying drawings.

DESCRIPTION OF THE PREFERRED EMBODIMENT

Figure 1:
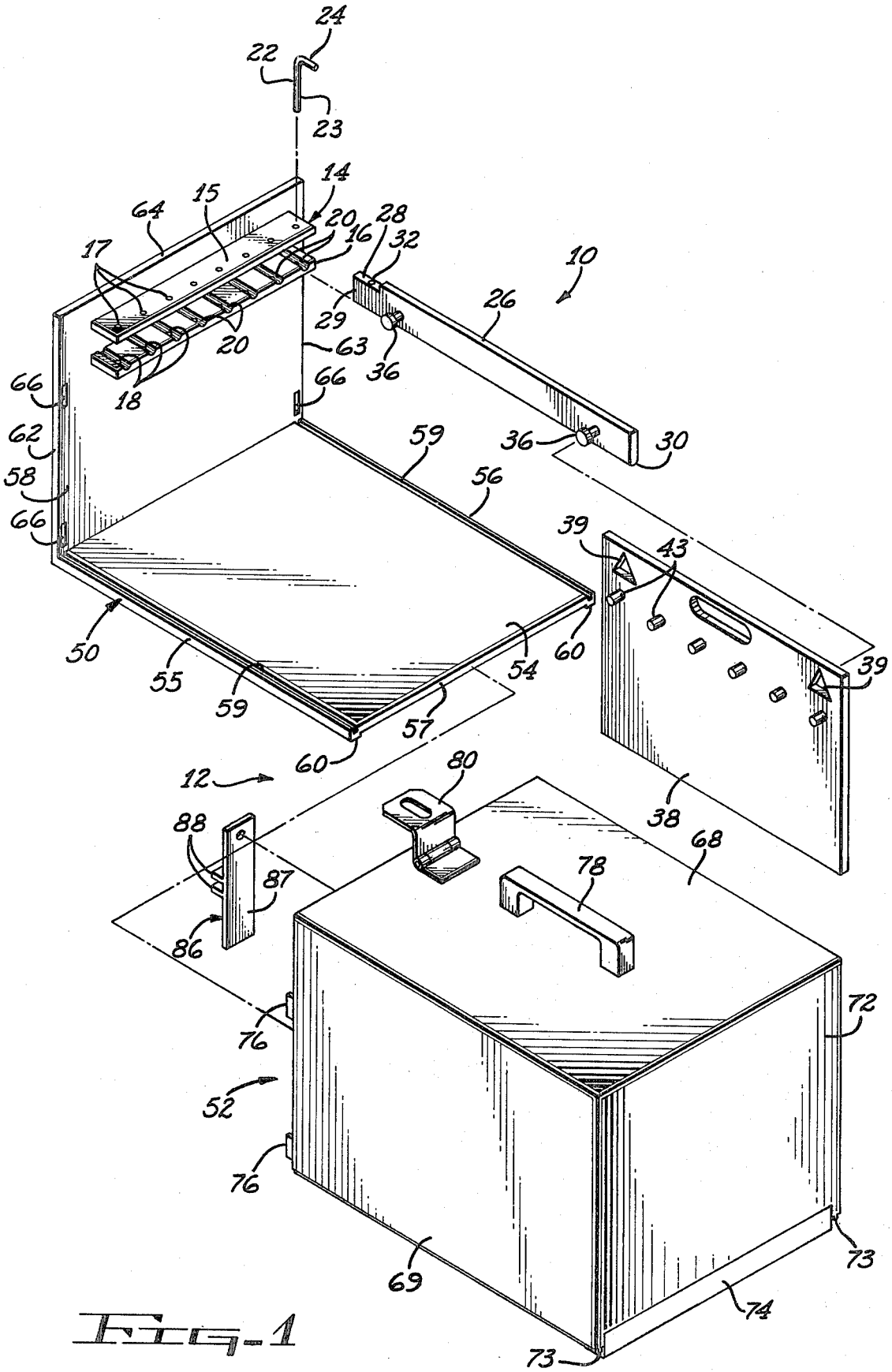
FIG. 1 is an exploded isometric view of the apparatus of the present invention showing the various features thereof and illustrating the apparatus in combination with a special carrying box.

Referring more particularly to the drawings, FIG. 1 illustrates the article supporting and display apparatus, which is indicated generally by the reference numeral 10, in combination with an especially configured carrying box that is indicated generally by the reference numeral 12. It should be understood that the combination of the apparatus 10 and the box 12 is the preferred embodiment of the present invention, but that the apparatus 10 can be employed in other environments as will hereinafter be described.

The article supporting and display apparatus 10 includes a mounting assembly 14 which may be affixed to any suitable vertical surface such as the interior surface of a cabinet (not shown), on the wall over a workbench (not shown), or in the carrying box 12 as will hereinafter be described.

In any event, the mounting assembly 14 preferrably includes an upper plate 15 and a lower plate 16 with those plates being spaced from each other and horizontally disposed in parallel relationship. Although shown as two separate plates, it should be obvious that the same results could be achieved by employing a channel member (not shown) of the well known type in which a pair of flanges extend normally in the same direction from opposite longitudinal edges of a flat plate.

The upper plate 15 of the mounting assembly 14 is provided with a plurality of apertures 17 formed therethrough and arranged in spaced increments along the length thereof. Likewise, the lower plate 16 has a similar number of apertures 18 formed therethrough with each of the apertures 18 lying on a vertical axis which is common with one of the apertures 17 of the top plate 15. Thus, the mounting assembly 14 is provided with a plurality of spacedly arranged vertically aligned pairs of the apertures.

The lower plate 16 of the mounting assembly 14 has a plurality of grooves 20 formed therein which are arcuate in cross section and disposed transversely of the lower plate. The grooves 20 are arranged along the length of the lower plate 16 so that each groove has a different one of the apertures 18 lying therein. Thus, the common axis of each aligned pair of apertures 17 and 18 normally intersects the longitudinal axis of a different one of the grooves 20.

The mounting assembly 14 also includes a plurality of L-shaped pins 22 with there being one pin demountably carried in each pair of the vertically aligned apertures 17 and 18. As seen best in FIG. 1, each of the pins 22 is provided with an elongated shank 23 having a head portion 24 formed thereon by which the pin is grasped for manual insertion and removal thereof as will hereinafter be described.

The above described mounting assembly 14 is employed for demountably and pivotably supporting a plurality of identical cantilever arms 26, with there being as many as one of those arms for each aligned pair of the apertures 17 and 18. The cantilever arms 26 may be of any suitable length and, since they are connected to the mounting assembly 14 in an on-edge position, the height dimension is somewhat critical in that it must be less than the spacing between the plates 15 and 16 of the mounting assembly 14. The required height dimension may be achieved by forming a longitudinally extending notch 28 along the top edge of each of the arms 26, with the notches being disposed adjacent the mounting ends 29 of the arms, or alternately, by fabricating the arms with the proper height dimension along their entire length (not shown). The bottom longitudinal edges 30 of the cantilever arms 26 are rounded so as to be arcuate in cross section so that when the arms are mounted in the mounting assembly 14 and are positioned to extend normally therefrom, as will hereinafter be described, those portions of the arcuate edges 30 which are adjacent the mounting ends 29 of the arms 26 will nestingly rest within their respective ones of the grooves 20 of the mounting assembly 14. The cantilever arms 26 are each provided with a bore 32 formed transversely through the mounting end 29 thereof so that mounting of the arms is accomplished by inserting the pins 22 so that they pass downwardly through the apertures 17 of the top plate 15, the bores 32 of the arms 26, and the apertures 18 of the bottom plate 16.

Figure 2:
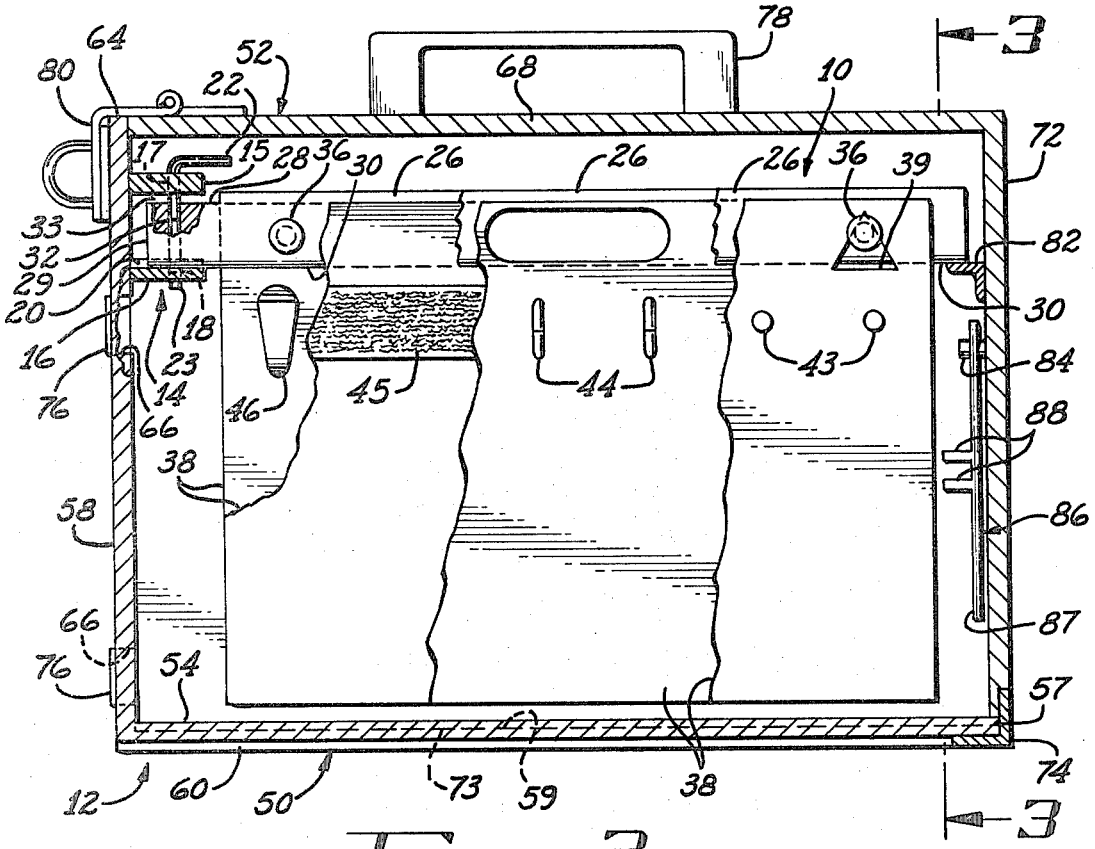
FIG. 2 is a longitudinal sectional view taken along a vertical plane which passes through the assembled special carrying box in which the apparatus is mounted, with portions of that apparatus being broken away to show the various features thereof.

As mentioned above, the cantilever arms 26 will extend normally from the mounting assembly 14 when their arcuate bottom edges 30 are positioned in the grooves 20 of the lower plate 16, and due to the grooves and the height dimension of the arms being less than the spacing between the plates 15 and 16, a gap 33, which is approximately equal to the depth of the grooves 20, will exist between the top edge of the arms and the downwardly facing surface of the top plate 15 as seen in FIG. 2. This relationship allows the arms 26 to be pivotably moved about their respective mounting pins 22, with such movement resulting from the exertion of a laterally applied force on the extending ends of the arms 26, which causes them to ride upwardly out of their grooves 20. This mounting arrangement of the cantilever arms 26 results in their being normally yieldingly held in the position of extending perpendicularly from the mounting assembly 14, with the pivotable movement capability being provided for access reasons as will become apparent as this description progresses.

The cantilever arms 26 are provided with a pair of headed pins 36 which extend from opposite sides of the arms and are located adjacent opposite ends thereof, with the headed pins 36 being employed for demountable suspension of display/organizer panel means 38 from the arms.

The display/organizer panel means 38 are each of planar configuration, and may be fabricated of any suitable material such as wood, metal, fabric, plastic, and the like, with the choice of such materials being determined by the articles that are to be displayed thereon. Each of the display panels 38 are formed with a pair of spaced apart apertures 39 formed adjacent the top edge, with those apertures being provided to engage the fastener pin means 36 of the cantilever arms when the display panels are demountably suspended therefrom. Thus, the headed pins 36 on the arms 26 and the apertures 39 of the display panels 38 cooperate to form complimentary elements of a demountable fastening means which may be in any suitable form.

As shown, the display panel means 38 are each provided with connector means thereon such as projecting pegs 43, hooks 44, Velcro fasteners 45, spring clips 46, and the like. The choice of the type of connector means and the arrangement of those connectors on the display panels is determined by the types of articles that are demountably connected thereto.

The above described article supporting and display apparatus 10 is preferrably mounted in the especially constructed carrying box 12 as hereinbefore mentioned, with that box 12 including a base 50 with a cover 52 demountably connected thereto.

Figure 3:
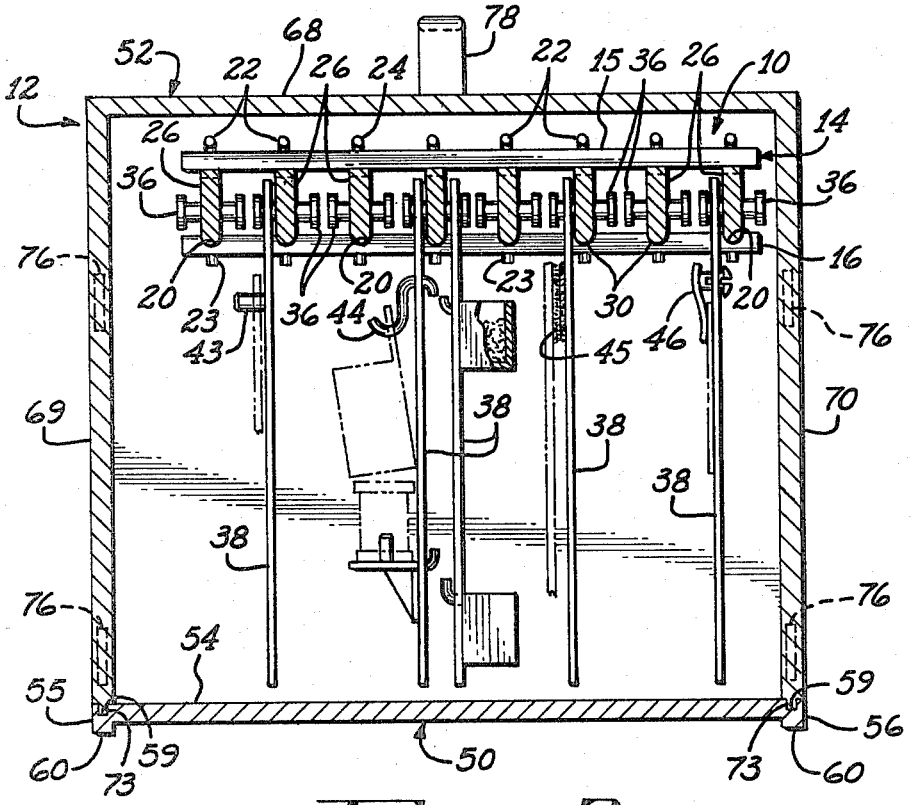
FIG. 3 is a sectional view taken on the line 3—3 of FIG. 2.

The base 50 of the box 12 is formed with a planar floor 54 of generally rectangular configuration having opposed side edges 55 and 56, and having a free end edge 57 with the opposite end edge having an integral upstanding end wall 58 formed thereon. The planar floor 54 is provided with channels 59 formed in the upwardly facing surface thereof, with the channels each disposed adjacent a different one of the opposed side edges 55 and 56 of the floor and extending longitudinally thereof. As seen best in FIG. 3, the floor 54 is also provided with ledges 60 which depend from the bottom surface of the floor, and are located adjacent the opposite side edges 55 and 56 and extend longitudinally therealong.

As will hereinafter be described, the channels 59 and ledges 60 are provided in the floor 54 of the base 50 so as to provide means for connecting the cover 52 to the base 50.

The upstanding end wall 58 of the base 50 has the mounting assembly 14 of the apparatus 10 suitably affixed to the inner surface thereof so that the cantilever arms 26 extend from the end wall 58 in spaced relationship above the floor 54, and the display panel means 38 depend from the arms 26 towards the floor. The upstanding wall 58 is formed with opposed side edges 62 and 63, a top edge 64, a and is provided with a pair of vertically spaced slots 66 formed adjacent each of the side edges 62 and 63, with the slots being employed for connecting the cover 52 to the base 50.

The cover 52 is formed with a top 68 which is of the same configuration and size as the floor 54 of the base 50, and the top has integral depending side walls 69 and 70 with one integral depending end wall 72, so that the end which is opposite the wall 72 is open. The side walls 69 and 70 each have a tongue 73 depending from the bottom edge thereof, and the end wall 72 has an angle bracket 74 affixed to its lowermost edge. Further, the side walls 69 and 70 each have a pair of tabs 76 extending from the free vertical edges thereof.

Demountable connection of the cover 52 to the base 50 is accomplished by placing the tongues 73 of the cover in the channels 59 of the base in an offset position, and slidably moving the cover 52 so that the open end thereof will move toward the upstanding wall 58 of the base. Such sliding movement will bring the angle bracket 74 into hooked engagement with the free end edge 57 of the base floor 54, and will move the tabs 76 of the cover 52 into the slots 66 of the upstanding wall 58 of the base 50. In this manner, the cover 52 is demountably coupled to the base 50 and is prevented from being decoupled as a result of lifting of the box 12.

The cover 52 of the box 12 is provided with a suitable handle 78 affixed to the top 68 by which the box may be carried, and a suitable hasp 80 is provided for locking the cover to the base. Further it will be appreciated that the above described demountable coupling of the base and cover will relieve all strain on the hasp 80, in that such hasps or similar devices, in conventional boxes of this general type usually provide the only interconnecting elements which results in them being normally the first elements to fail due to the strain applied thereto.

As shown in FIG. 2, the cover 52 is provided with a shelf means in the form of an angle bracket 82 affixed on the inner surface of the end wall 72 so that upon mounting of the cover to the base 50, the angle bracket 82 will supportingly engage free ends of the cantilever arms 26, thus, preventing damage thereto which could occur as a result of vibration, jarring, and the like during transport of the carrying box 12.

The same inner surface of the end wall 72 of the cover 52 has a peg 84 extending therefrom for demountably carrying a stand means 86 thereon. The stand means 86, as best seen in FIG. 1, includes a strap member 87 with a spaced pair of ribs 88 extending therefrom intermediate the opposite ends. The stand means 86 is employed for supporting the display pannels 38 in an upright position when removed from the mounting assembly 14 for remote display purposes. Although only one of the stands 86 is shown, it will be understood that a plurality of such stands, or similar structures, may be mounted within the box 12.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An apparatus for supportingly displaying miscellaneous articles in organized arrays comprising:

(a) a mounting assembly for attachment to a vertical surface, said mounting assembly including an upper plate and a lower plate which are spaced from each other and horizontally disposed in parallel relationship;

(b) at least one elongated cantilever arm demountably pivotably coupled in an on-edge attitude between the upper and lower plates of said mounting assembly so as to be extending therefrom;

(c) means on said mounting assembly and on said cantilever arm for demountable pivotable coupling of said cantilever arm to said mounting assembly;

(d) means on said mounting assembly and on said cantilever arm for yieldably holding said cantilever arm in a position of normally extending from said mounting assembly;

(e) at least one display panel;

(f) complimentary elements of a fastener means on said cantilever arm and on said display panel for demountably suspending said display panel from said cantilever arm;

(g) connector means on said display panel for demountably supporting miscellaneous articles thereon in organized arrays; and (h) a box having an inwardly facing vertical surface to which said mounting assembly is fixedly attached, said box including, I. a base having a floor with an integral upstanding end wall to which said mounting assembly is affixed, II. a cover having a top from which an opposed pair of side walls and an end wall integrally depend, and III. means on said base and on said cover for demountably coupling said cover to said base.

2. An apparatus as claimed in claim 1 wherein said means on said mounting assembly and on said cantilever arm for demountably pivotably coupling said cantilever arm on said mounting assembly comprises a pin removably passing through the upper plate of said mounting assembly, through one end of said cantilever arm and through the lower plate of said mounting assembly.

3. An apparatus as claimed in claim 1 wherein said means on said mounting assembly and on said cantilever arm for demountably pivotably coupling said cantilever arm on said mounting assembly comprises:

(a) said upper plate of said mounting assembly having at least one aperture formed therethrough;

(b) said lower plate of said mounting assembly having at least one aperture formed therethrough with the aperture of said lower plate and the aperture of said upper plate being disposed on a common vertical axis;

(c) said cantilever arm having a bore formed transversely therethrough adjacent one end, said cantilever arm being disposed so that the bore thereof lies between the apertures of said upper and said lower plates and is coaxial with the common axis thereof; and (d) a pin removably passing downwardly through the aperture of said upper plate, through the bore of said cantilever arm and through the aperture of said lower plate, said cantilever arm being pivotably movable about the longitudinal axis of said pin.

4. An apparatus as claimed in claim 1 wherein said means on said mounting assembly and on said cantilever arm for yieldingly holding said cantilever arm in a normally extending position comprises a groove formed transversely in the upwardly facing surface of the lower plate of said mounting assembly with that groove displacingly nestingly containing the bottom longitudinal edge of said cantilever arm.

5. An apparatus as claimed in claim 4 wherein the groove formed in the lower plate of said mounting assembly is arcuate in cross section and the bottom longitudinal edge of said cantilever arm is rounded so as to be arcuate in cross section.

6. An apparatus as claimed in claim 1 wherein said means for demountably pivotably coupling said cantilever arm to said mounting assembly, and said means for yieldingly holding said cantilever arm in a normally extending position comprises:

(a) said upper plate of said mounting assembly having at least one aperture formed therethrough;

(b) said lower plate of said mounting assembly having at least one aperture formed therethrough with the aperture of said lower plate and the aperture of said upper plate being disposed on a common vertical axis;

(c) said lower plate having at least one groove formed transversely in the upwardly facing surface thereof with said groove disposed so that its longitudinal axis normally intersects the common vertical axis of the apertures formed in said upper and said lower plates;

(d) said cantilever arm having a bore formed transversely through one end thereof, said cantilever arm disposed so that its bottom longitudinal edge is displacingly nestingly positioned in the groove of said bottom plate and so that the bore thereof is disposed between the apertures of said upper and said lower plates and is coaxial with the common axis thereof; and (e) a pin demountably passing downwardly through the aperture of said upper plate, through the bore of said cantilever arm and through the aperture of said lower plate, said cantilever arm pivotably movable about the longitudinal axis of said pin.

7. An apparatus as claimed in claim 1 wherein said complimentary elements of a fastener means comprises:

(a) a pair of headed pins mounted in spaced relationship along the length of said cantilever arm so as to extend normally from one of the vertical surfaces; and (b) said display panel having a spaced pair of apertures formed adjacent the top edge thereof with those apertures each having a different one of said pair of headed pins removably passing therethrough.

8. An apparatus as claimed in claim 1 wherein said box further comprises:

(a) said base including,

I. said floor having an opposed pair of side edges and one free end edge,

II. said upstanding wall extending from the opposite end edge of said floor and having said mounting assembly affixed thereto, III. said floor having a pair of upwardly opening channels formed therein with each channel extending along a different one of the side edges thereof, and IV. said upstanding wall having at least a pair of slots formed therein with each slot adjacent a different vertical side edge thereof; and (b) said cover lowerable onto said base and slidably movable relative thereto, said cover including, I. said top, II. said opposed pair of side walls depending from said top and each having a free vertical edge, III. at least one tab extending from each of the free vertical edges of said side walls for entry into different one of the slots of said upstanding wall when said cover is slidably moved relative to said base, IV. a tongue depending from the bottom edge of each of said walls for entry into different ones of the channels of said floor with said tongues slidably movable in those channels when said cover is slidably moved relative to said base, V. said end wall depending from said top, VI. an angle bracket attached to the lower edge of said depending end wall, said angle bracket for hooked engagement with the free end edge of said floor when said cover is slidably moved relative to said base.

9. An apparatus as claimed in claim 8 wherein said box means further comprises:

(a) hasp means on said cover and on said base for lockably coupling said cover to said base; and (b) a handle extending from said top of said cover.

10. An apparatus as claimed in claim 8 and further comprising shelf means on the inwardly facing suface of said depending end wall of said cover for supportingly engaging the extending end of said cantilever arm.

* * * * *